US005914181A

United States Patent [19]

Uchino et al.

[11] Patent Number: 5,914,181

[45] Date of Patent: Jun. 22, 1999

[54] COATED CEMENTED CARBIDE MEMBER

[75] Inventors: Katsuya Uchino; Toshio Nomura; Mitsunori Kobayashi; Masuo Chudo, all of Hyogo, Japan

[73] Assignee: Sumitomo Electric Industries, Ltd., Osaka, Japan

[21] Appl. No.: 08/885,982

[22] Filed: Jun. 30, 1997

Related U.S. Application Data

[63] Continuation of application No. 08/361,030, Dec. 21, 1994, Pat. No. 5,643,658, which is a continuation of application No. 08/039,976, Mar. 30, 1993, abandoned.

[30] Foreign Application Priority Data

| | | | |
|---|---|---|---|
| Apr. 17, 1992 | [JP] | Japan | 4-125541 |
| May 6, 1992 | [JP] | Japan | 4-142220 |
| Jul. 9, 1992 | [JP] | Japan | 4-182511 |

[51] Int. Cl.[6] ..... C23C 30/00

[52] U.S. Cl. ..... 428/216; 428/212; 428/469; 428/697; 428/698; 428/699; 428/701; 428/702; 428/336; 407/119; 51/295; 51/307; 51/309

[58] Field of Search ..... 428/212, 216, 428/469, 472, 697, 698, 699, 701, 702, 336; 407/119; 51/295, 307, 309

[56] References Cited

U.S. PATENT DOCUMENTS

| | | |
|---|---|---|
| 3,690,962 | 9/1972 | Rudy . |
| 3,909,895 | 10/1975 | Abrahamson et al. . |
| 4,497,874 | 2/1985 | Hale . |
| 4,610,931 | 9/1986 | Nemeth et al. . |
| 4,698,266 | 10/1987 | Buljan et al. . |
| 4,743,515 | 5/1988 | Fischer et al. . |
| 4,828,612 | 5/1989 | Yohe . |
| 5,066,553 | 11/1991 | Yoshimura et al. . |
| 5,250,367 | 10/1993 | Santhanam et al. . |

FOREIGN PATENT DOCUMENTS

| | | |
|---|---|---|
| 0127416 | 5/1984 | European Pat. Off. . |
| 0200991 | 11/1986 | European Pat. Off. . |
| 0337696 | 10/1989 | European Pat. Off. . |
| 0560212 | 9/1993 | European Pat. Off. . |
| 55-83517 | 6/1980 | Japan . |
| 1133995 | 11/1968 | United Kingdom . |
| 2095702 | 10/1982 | United Kingdom . |

OTHER PUBLICATIONS

1979, Powder and Powder Metallurgy, vol. 26, No. 6, H. Suzuki et al. "Effects of a Small Amount of Addition–Carbides on High Temperature Transverse–Rupture Strength of WC–Co Cemented Carbide".

(List continued on next page.)

*Primary Examiner*—Archene Turner
*Attorney, Agent, or Firm*—W. F. Fasse; W. G. Fasse

[57] ABSTRACT

A coated cemented carbide member includes a cemented carbide base material containing a binder metal of at least one iron family metal and a hard phase, and a coating layer provided on the surface of the cemented carbide base material. The hard phase contains at least one metal component selected from carbides, nitrides, carbo-nitrides and carbonic nitrides of Zr and/or Hf and WC. A layer consisting of only WC and an, iron family metal or a binder phase enriched layer or a low hardness layer is provided on an outermost surface of each insert edge portion of the cemented carbide base material. The coating layer is a single or multiple layer consisting of at least one metal component selected from carbides, nitrides, carbo-nitrides, oxides and borides of metals belonging to the groups IVB, VB and VIB of the periodic table. Due to this structure, it is possible to improve chipping resistance with no deterioration of wear resistance in the coated cemented carbide member to be used, for example, as a cutting tool.

13 Claims, 6 Drawing Sheets

OTHER PUBLICATIONS

Transactions of the Japan Institute of Metals, vol. 45, No. 1, 1981 "The β–Free Layer Formed Near The Surface of Sintered WC–β–Co Alloy Containing Nitrogen", by H. Suzuki et al., pp. 95–99.

"Kinetics of Compositional Modification of (W, Ti)C–WC–Co Alloy Surfaces" in Materials Science and Engineering A105/106 (1988), pp. 225 to 231, by Schwarzkopf et al.

Schwarzkopf et al. "Cemented Carbides"; pp. 136–138, 1960.

The β–Free Layer Formed Near the Surface of Vacuum–Sintered WC–β–Co Alloys Containing Nitrogen; by Suzuki et al., Transactions of the Japan Institute of Metals. vol. 22, No. 11 (1981), pp. 694–700.

COATED CEMENTED CARBIDE MEMBER

This application is a continuation of Ser. No. 08/361,030 filed Dec. 21, 1994 now U.S. Pat. No. 5,643,658 which is a continuation of Ser. No. 08/039,976 filed Mar. 30, 1993 now abandoned.

BACKGROUND OF THE INVENTION

1. Field of the Invention

The present invention relates to a coated cemented carbide member which is applied to a cutting tool or the like and a method of manufacturing the same, and more particularly, it relates to a coated cemented carbide member which is excellent in toughness and wear resistance and a method of manufacturing the same.

2. Description of the Background Art

A coated cemented carbide member, which comprises a cemented carbide base material and a coating layer of titanium carbide or the like vapor-deposited on its surface, is generally applied to a cutting tool of high efficiency for cutting a steel material, a casting or the like, due to toughness of the base material and wear resistance of the surface.

Cutting efficiency of such a cutting tool is improved in recent years. The cutting efficiency is decided by the product of a cutting speed (V) and an amount of feed (f). When the cutting speed V is increased, the tool life is rapidly reduced. Therefore, improvement of the cutting efficiency is attained by increasing the amount of feed f. In order to improve the cutting efficiency by increasing the amount of feed f it is necessary to prepare a base material of the cutting tool from a tough material which can withstand high cutting stress.

In order to improve cutting characteristics of a cutting tool by implementing inconsistent characteristics of wear resistance and chipping resistance, various proposals have been made in general. For example, there have been proposed cemented carbide base materials which are provided on outermost surfaces thereof with a layer (enriched layer) containing an iron family metal in a larger amount than that in the interior, a layer (β free layer) consisting of only WC and a binder metal, and a region (low hardness layer) having lower hardness as compared with the interior, in order to improve wear resistance and chipping resistance.

In an insert shown in FIG. 1, however, absolutely no β free layer is formed particularly in each cornered insert edge portion 1, while the thickness of the as-formed β free layer is extremely reduced in a peripheral portion of such a corner. Further, the insert edge portion 1 has higher hardness than the interior due to reduction of a binder phase and increase of a hard phase, and hence it is impossible to attain sufficient wear resistance and chipping resistance. When generally employed chemical vapor deposition is applied to a coating method in such a coated cemented carbide, a fragile η phase is caused in the cornered insert edge portion 1 by reaction with carbon forming the base material in formation of the coating layer. Thus, chipping resistance is lowered and the coating layer falls with the η phase portion, to cause progress of wear.

In order to improve strength of a cemented carbide, there is a method of increasing the amount of the binder phase contained in the cemented carbide. In this case, however, plastic deformation is caused in the insert under a high cutting speed condition due to a high temperature applied thereto, although toughness is improved by such increase of the amount of the binder phase.

On the other hand, there is a method of increasing the amounts of additives such as Ti and Ta in the cemented carbide to improve heat resistance, thereby improving the tool life. In this case, however, strength of the cemented carbide is extremely reduced.

SUMMARY OF THE INVENTION

An object of the present invention is to provide a coated cemented carbide member which is remarkably improved in chipping resistance with no deterioration of wear resistance.

Another object of the present invention is to provide a coated cemented carbide member having both of wear resistance and toughness in cutting work of high efficiency.

According to a first aspect of the present invention, a coated cemented carbide member comprises a cemented carbide base material, containing a binder metal of at least one iron-family metal and a hard phase of at least one metal component selected from carbides, nitrides, carbo-nitrides and carbonic nitrides of metals belonging to the groups IVB, VB and VIB of the periodic table, and a coating layer provided on its surface. The hard phase contains at least one element selected from carbides, nitrides, carbo-nitrides and carbonic nitrides of Zr and/or Hf, and WC. Each insert edge portion of this cemented carbide member is provided-on its outermost surface with a layer consisting of only WC and an iron family metal. The coating layer is formed by a single or multiple layer which consists of at least one material selected from carbides, nitrides, carbo-nitrides, oxides and borides of metals belonging to the groups IVB, VB and VIB of the periodic table and aluminum oxide.

According to this structure, a β free layer is also formed on the insert edge portion, whereby it is possible to improve chipping resistance of the cemented carbide member with no deterioration of wear resistance.

In a preferred embodiment of the inventive coated cemented carbide member, the layer, provided on the surface of the base material, consisting of only WC and an iron family metal has a thickness of 5 to 50 μm in each flat portion forming each insert edge portion and 0.1 to 1.4 times that of the flat portion in the insert edge portion.

While the coated cemented carbide member according to the first aspect of the present invention has the layer consisting of only WC and an iron family metal on the outermost surface of each insert edge portion, a coated cemented carbide member according to a second aspect of the present invention is characterized in that each insert edge portion of a base material is provided on its outermost surface with an enriched layer of a binder phase containing a larger amount of a binder metal as compared with the interior. As to the remaining structure, this coated cemented carbide member is similar to that according to the first aspect of the present invention.

Also according to this structure, it is possible to improve chipping resistance with no deterioration of wear resistance since an enriched layer and a low hardness layer are formed on a cornered portion such as an insert edge portion.

In a preferred embodiment of this coated cemented carbide member, the thickness of the enriched layer is 5 to 100 μm in a flat portion of each surface forming each insert edge portion and 0.1 to 1.4 times that in the flat portion in the insert edge portion. If this multiplying factor is less than 0.1 times, chipping resistance is disadvantageously deteriorated to the same degree as that of a conventional cemented carbide member having no enriched layer, although excellent wear resistance is maintained. If the multiplying factor exceeds 1.4 times, on the other hand, wear resistance is disadvantageously deteriorated although chipping resistance is remarkably improved as compared with the prior art.

Further, an amount of the iron family metal contained in a portion of the insert edge portion immediately under the coating layer in a range of up to 2 to 50 μm in depth from the surface of the base material is preferably 1.5 to 5 times that in the interior in weight ratio. If this multiplying factor is less than 1.5 times, sufficient improvement of chipping resistance cannot be attained although excellent wear resistance is maintained. If the multiplying factor exceeds 5 times, on the other hand, wear resistance is disadvantageously deteriorated although chipping resistance is improved.

It is also possible to improve chipping resistance with no deterioration of wear resistance by forming a low hardness layer having lower hardness than the interior in the portion immediately under the coating layer in the range of up to 2 to 50 μm from the surface of the base material.

It is preferable that internal hardness of the coated cemented carbide base material is 1300 to 1700 kg/mm$^2$ in Vickers hardness (Hv) with a load of 500 g, and hardness of the low hardness layer which is formed on the insert edge portion is 0.6 to 0.95 times the internal hardness. If this multiplying factor is less than 0.6 times the internal hardness, a tendency of deterioration in wear resistance is observed. If the multiplying factor exceeds 0.95 times, on the other hand, improvement of chipping resistance is reduced.

In the coated cemented carbide member according to the first or second aspect of the present invention, it is possible to further improve wear resistance and plastic deformation resistance in the structure having a β free layer, a binder phase enriched layer or a low hardness layer on the outermost surface of the base material including each insert edge portion when the hard phase contains at least one metal component selected from carbides, nitrides and carbonitrides of Zr and/or Hf and a solid solution of at least one metal component selected from carbides, nitrides and carbonitrides of metals belonging to the group VB of the periodic table as well as WC.

This is because a region having higher hardness than the interior is defined in a range of up to 1 to 200 μm in depth from the region of the surface layer, i.e., β free type layer or the binder phase enriched layer, due to employment of such a composition, thereby improving plastic deformation resistance. Such improvement of plastic deformation resistance is caused since the amount of at least one metal component selected from carbides, nitrides and carbo-nitrides of metals, having high hardness, belonging to the group VB of the periodic table is increased in the range of up to 1 to 200 μm in depth from the region of the surface layer of the base material as compared with the interior.

Such a hard region defined in immediately under the region of surface layer of the base material is preferably 1 to 200 μm in thickness. No particular improvement is recognized if the thickness is less than 1 μm, while a tendency of insufficient chipping resistance is recognized if the thickness exceeds 200 μm, although effects are improved as to wear resistance and plastic deformation resistance.

The maximum hardness of such a hard region is preferably in a range of 1400 to 1900 kg/mm$^2$ in Vickers hardness (Hv) with a load of 500 g. If the maximum hardness is in a range of less than 1400 kg/mm$^2$, a tendency of insufficient wear resistance and plastic deformation resistance is recognized although an effect as to chipping resistance is improved. If the maximum hardness is in a range exceeding 1900 kg/mm$^2$, on the other hand, a tendency of insufficient chipping resistance is recognized although effects as to wear resistance and plastic deformation resistance are improved.

The coated cemented carbide according to the first or second aspect of the present invention is manufactured by the following method: First, a coated cemented carbide base material is sintered and thereafter each edge portion of the base material is polished for bevelling in a range for leaving a β free layer, an enriched layer or a low hardness layer, or the coated cemented carbide base material is so sintered that each edge portion of the base material is previously bevelled by die pressing in the aforementioned range. The bevelling includes chamfering and curving of the edge portion.

In order to adjust the thickness of each insert edge portion of the coated cemented carbide member while leaving a β free layer, an enriched layer or a low hardness layer on the edge portion, there is a method of employing powder which is prepared by changing the total amount of at least one material selected from carbides, nitrides, carbo-nitrides and carbonic nitrides of Zr and/or Hf in a hard phase and holding the same in a vacuum or a constant nitrogen pressure in a temperature range of 1350° to 1500° C.

Further, it is possible to bevel each insert edge portion of the as-obtained sintered body by brushing with ceramic grains such as alumina grains or GC abrasive grains, honing by barrel polishing or grinding, thereby adjusting the ratio of a thickness of a β free layer, an enriched layer or a low hardness layer to that of the layer in each portion excluding the edge portion. It is also possible to form a β free layer, an enriched layer or a low hardness layer on each insert edge portion by employing powder having a composition similar to the above, previously forming the powder into a shape having a bevelled insert edge portion by die pressing and sintering the same in a similar method.

Thereafter a coating layer is formed on such a base material of cemented carbide. This coating layer is a single or multiple layer of at least one metal component selected from carbides, nitrides, carbo-nitrides, oxides and borides of metals belonging to the groups IVB, VB and VIB of the periodic table and aluminum oxide, which is formed by ordinary chemical or physical vapor deposition. Due to this coating layer, it is possible to improve wear resistance and chipping resistance in high-speed cutting in a balanced manner.

In a more preferred embodiment of the coated cemented carbide member according to the first or second aspect of the present invention, a structure having no η phase on an outermost surface of a base material in each insert edge portion is combined with a structure having a β free layer, a binder phase enriched layer or a low hardness layer on the outermost surface of the base material including such an insert edge portion. Due to this structure, it is possible to further improve wear resistance and chipping resistance. Since no fragile η phase is contained in the insert edge portion, on which a η layer is most easily precipitated in ordinary chemical vapor deposition, it is possible to prevent deterioration of insert strength caused by brittleness of the η phase thereby improving chipping resistance, while it is also possible to prevent such a phenomenon that the coating layer falls with the fragile η phase in cutting work to progress wear, thereby improving wear resistance.

As to manufacturing of such a structure containing no η phase in the insert edge portion on the outermost surface of the base material, there is a method of forming a first coating layer which is in direct contact with the base material by physical vapor deposition or chemical vapor deposition employing a raw material requiring a smaller amount of carbon supply from the base material as compared with conventional chemical vapor deposition using methane as a carbon source. Considering the degree of adhesion (peeling resistance) with respect to the base material, it is particularly effective to employ acetonitrile as a carbide and nitride source for forming the coating layer in a temperature range of at least 900° C. by MT-CVD (moderate temperature-chemical vapor deposition).

According to a third aspect of the present invention, a coated cemented carbide member has the following structure in a cemented carbide containing binder metals of WC and one or more iron family metals:

The cemented carbide contains 0.3 to 15 percent by weight of a hard phase consisting of at least one metal component selected from a group of carbides, nitrides and carbo-nitrides of Zr and/or Hf and a solid solution of at least two such metal components. The cemented carbide further contains 2 to 15 percent by weight of only Co or Co and Ni as a binder phase. The cemented carbide contains tungsten carbide and unavoidable impurities in addition to the hard phase and the binder chase.

Due to such compositions of the hard chase and the binder phase, it is possible to improve wear resistance and chipping resistance of a tool in a well-balanced manner under high speed and high feed rate cutting conditions. In ordinary cutting work of a steel material or a casting, the temperature at the insert of the tool is increased to several 100° to 1000° C., leading to remarkable reduction in strength and hardness of the cemented carbide forming the tool. When a carbide of Zr or Hf and the like are added to the cemented carbide within the range of the present invention, strength of the cemented carbide is improved not only at the room temperature but in a high temperature range as compared with a conventional cemented carbide containing only a carbide of Ti, Ta or Nb etc., while it is possible to maintain high hardness under a high temperature. A cemented carbide containing a carbide of Zr or Hf and the like in the range of the present invention has relatively low hardness at the room temperature as compared with the prior art, while its hardness exceeds that of the prior art at a high temperature around a cutting temperature. Thus, the inventive cemented carbide is improved in hardness under a high temperature as compared with a conventional cemented carbide of the same composition containing the same amounts of a carbide and the like, whereby it is possible to maintain excellent wear resistance while improving toughness of the cemented carbide by reducing the amount of the hard phase and increasing that of the binder phase as compared with the prior art.

Further, the surface of the cemented carbide base material having such a structure is provided with the single or multiple coating layer consisting of one or more metal components selected from carbides, nitrides, oxides and borides of metals belonging to the groups IVB, VB and VIB of the periodic table and aluminum oxide.

Due to provision of such a coating layer, wear resistance is ensured on the surface of the cemented carbide. Such a coating layer is formed by ordinary chemical or physical vapor deposition.

If the amount of the hard phase consisting of at least one metal component selected from a group of carbides, nitrides and carbo-nitrides of Zr and/or Hf and a solid solution of at least two such metal components is less than 0.3 percent by weight, no sufficient effects are attained as to improvement cemented carbide strength and hardness in a high temperature range and no-sufficient effect of improvement in tool life can be attained in cutting in a high temperature range or at a high speed. If the amount exceeds 15 percent by weight, on the other hand, strength of the cemented carbide is extremely reduced with insufficient toughness, leading to reduction of the tool life.

If the amount of the binder phase is less than 2 percent by weight, the tool life cannot be improved due to reduction in sintering property of the cemented carbide. If the amount exceeds 15 percent by weight, on the other hand, the tool life cannot be improved due to reduction in plastic deformation resistance.

Zr and/or Hf can be previously added to a metal in the form of a carbide in which W is dissolved, or a carbo-nitride. Also when a carbo-nitride of Zr forms a solid solution with Hf, it is possible to attain a similar effect.

It is generally known possible to improve strength of a WC-Co cemented carbide by adding Zr and/or Hf etc. thereto ("Powder and Powder Metallurgy" Vol. 26, No. 6, p. 213). As to the amount of such additive, however, studs has generally been made only in relation to a small amount of not more than 5 mol percent with respect to 10 percent of Co forming a binder phase (not more than 0.9 percent by weight in the case of ZrC and not more than 1.6 percent by weight in the case of HfC in the cemented carbide). According to the present invention, at least 5 mol percent of such additive is added with respect to a binder phase. The inventors have made study as to a region containing a larger amount of such additive as compared with the prior art, to find that employment of a cemented carbide having a composition of this region has an effect in improvement of a tool life for the first time.

According to a preferred embodiment of this coated cemented carbide member, a hard phase consisting at least one metal component selected from a group of carbides, nitrides and carbo-nitrides of Zr and/or Hf and a solid solution of at least two such metal components disappears or decreases in a region immediately under the coating layer in a range of up to 2 to 100 $\mu$m in depth from the surface of the cemented carbide base material.

Toughness of the cemented carbide surface can be improved by such a structure, while toughness of the overall cemented carbide can be further improved by combination with the aforementioned composition in its interior. It is well known that a carbide of Ti etc. disappears from a cemented carbide surface by employment of a carbide or a carbo-nitride of Ti (Transactions of the Japan Institute of Metals, Vol. 45, No. 1, p. 90, for example). In a conventional tool of such a structure, however, the carbide and the like still remain in each insert edge portion of the tool. When a carbide or a carbo-nitride of Zr or Hf is added to the cemented carbide in the inventive coated cemented carbide member, on the other hand, the carbide or carbo-nitride disappears or decreases also in each insert edge portion. Due to this structure, it is possible to extremely improve toughness of an insert of a tool as compared with the prior art. If the layer in which a hard phase of Zr or Hf disappears or decreases is less than 2 $\mu$m in thickness from the surface of the base material, however, no effect is attained as to toughness of the surface. If the thickness exceeds 100 $\mu$m, on the other hand, wear resistance is reduced. Thus, the thickness of the layer is preferably in a range of 5 to 50 $\mu$m.

It is possible to control the thickness of the layer in which the hard phase disappears or decreases by adding a hard phase of Zr and/or Hf as a carbide, a nitride or a carbo-nitride, heating/holding the mixture in a vacuum or under a constant nitrogen pressure in a temperature range of 1350° to 1500° C. and controlling the holding time and the degree of vacuum or the nitrogen pressure.

A coated cemented carbide member according to a fourth aspect of the present invention is similar in composition to that according to the third aspect. In addition to the aforementioned hard phase, this coated cemented carbide member further-contains 0.03 to 35 percent by weight of another-hard phase consisting of at least one metal component selected from carbides, nitrides and carbo-nitrides of metals, excluding Zr and Hf, belonging to the groups IVB, VB and VIB of the periodic table and a solid solution of at least two such metal components.

The coated cemented carbide member of such a structure has the following characteristics:

It is possible to improve toughness of a cemented carbide containing a carbide of Zr or Hf and the like by increasing the amount of a binder phase as compared with a conventional cemented carbide, since such a cemented carbide has high strength and hardness under a high temperature. However, this cemented carbide exhibits low hardness under a low temperature. When the cemented carbide contains only a hard phase of a carbide of Zr or Hf and the like, therefore, wear resistance may be insufficient under cutting conditions causing no increase of a temperature at the insert. In order to compensate for such insufficiency of wear resistance under such conditions, a carbide having high hardness selected from those of metals, excluding Zr and Hf, belonging to the groups IVB, VB and VIB of the periodic table and the like are added to the cemented carbide in addition to the carbide of Zr or Hf and the like, so that it is possible to maintain excellent hardness under a low temperature. If the amount of the carbide selected from those of metals, excluding Zr and Hf, belonging to the groups IVB, VB and VIB of the periodic table is less than 0.03 percent by weight, however, no effect is attained as to improvement of hardness. If the amount exceeds 35 percent by weight, on the other hand, hardness is excessively increased to cause chipping, leading to reduction in tool life.

Other reasons for restriction of numerical values of the hard phase and a binder phase are similar to those for the aforementioned coated cemented carbide member according to the third aspect of the present invention.

Also in the coated cemented carbide member according to the fourth aspect of the present invention, the hard phase preferably disappears or decreases in a region immediately under the coating layer in a range of up to 2 to 100 $\mu$m in depth from the base material surface, similarly to the coated cemented carbide member according to the third aspect. The reason for this is identical to that described above with reference to the preferred embodiment of the coated cemented carbide member according to the third aspect of the present invention, and the thickness of such a layer is also preferably in a range of 5 to 50 $\mu$m.

In order to control this thickness, it is possible to apply a method which is similar to that described above with reference to the coated cemented carbide member according to the third aspect of the present invention.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Examples of the present invention are now described.

EXAMPLE 1

Grade powder materials having compositions A to D (wt. %) shown in Table 1 were formed into tips each having a shape of CNMG120408 under ISO standards (see FIG. 1), heated to a temperature of 1450° C. in a vacuum and held at this temperature for 1 hour, and thereafter cooled. Then insert edge portions 1 of the as-obtained sintered bodies were honed with a brush employing GC abrasive grains, to be provided with curved surfaces. Thereafter the sintered bodies serving as base materials were coated with inner layers of a carbide, a nitride and a carbo-nitride of Ti having thicknesses of 7 $\mu$m in total and outer layers of aluminum oxide having thicknesses of 1 $\mu$m.

Figure 1:
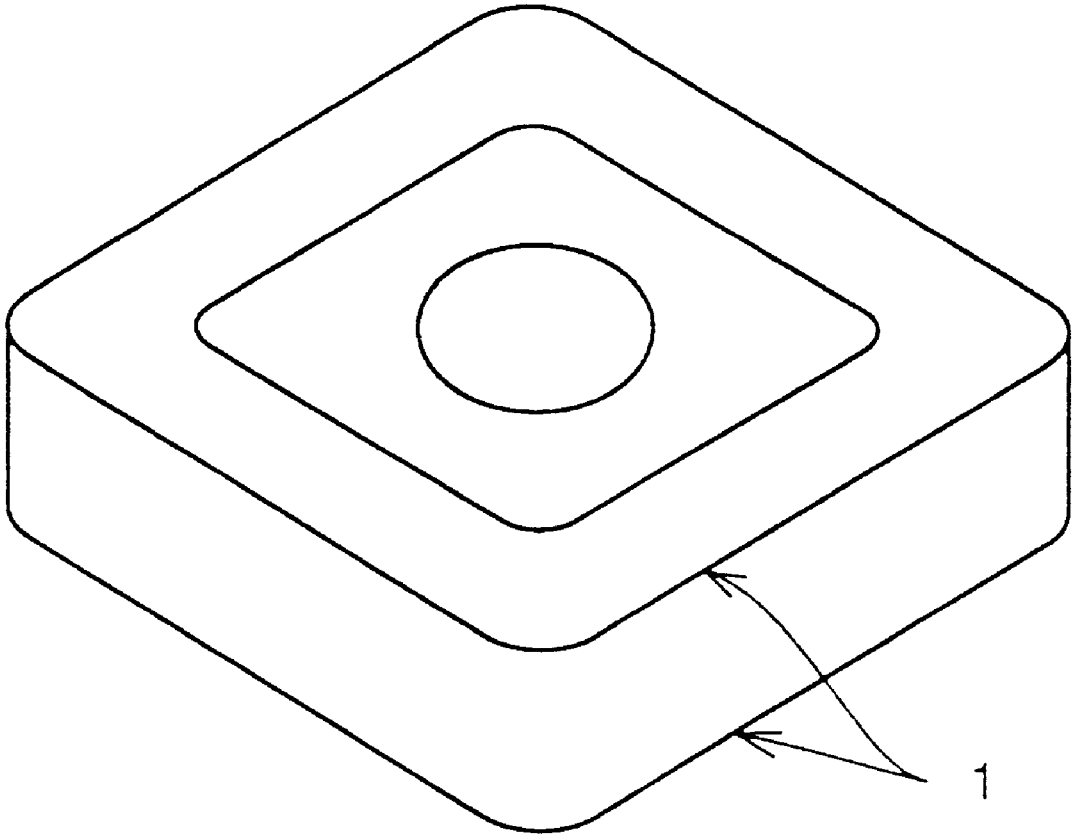
FIG. 1 PRIOR ART
FIG. 1 is a perspective view showing the shape of an insert of CNMG120408 under the ISO standards.
Figure 2A:
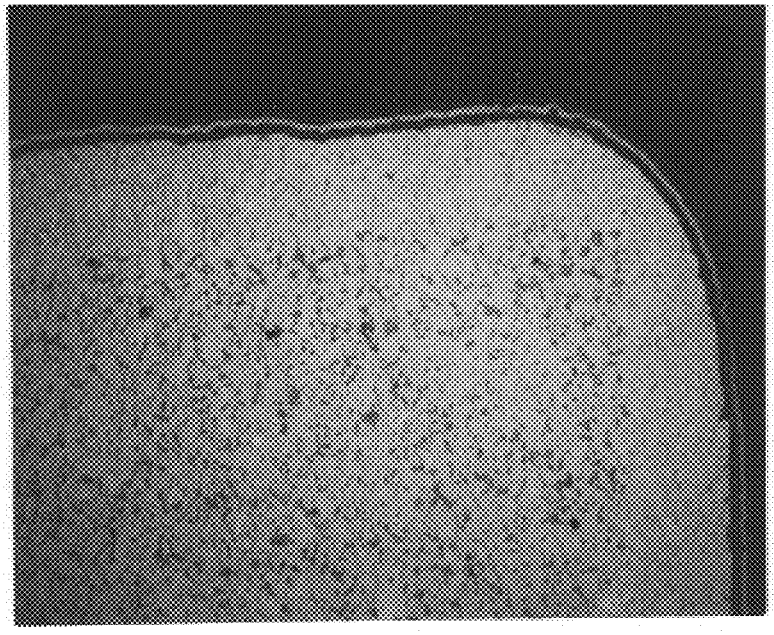
FIG. 2A is a structural photograph showing a section in an insert edge portion of a coated cemented carbide member according to Example 1 of the present invention.
Figure 2B:
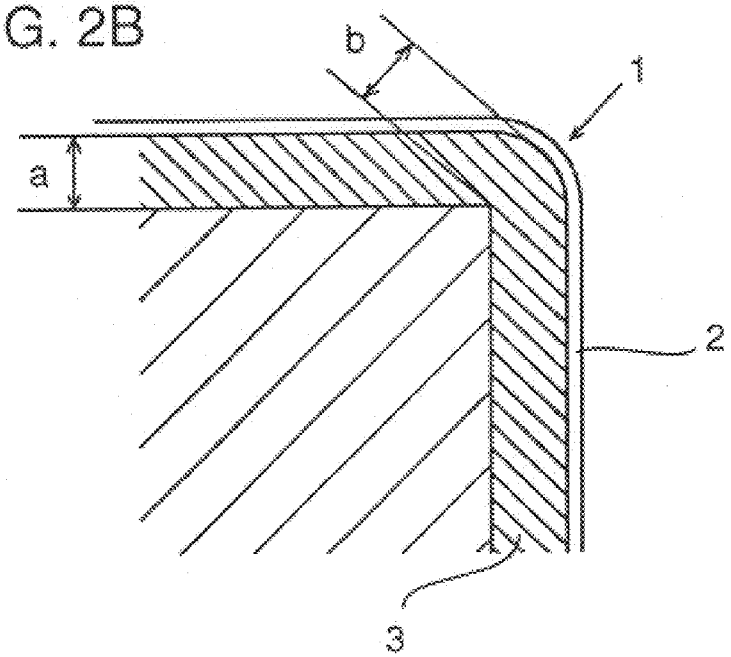
FIG. 2B is a model diagram thereof.
Figure 3A:
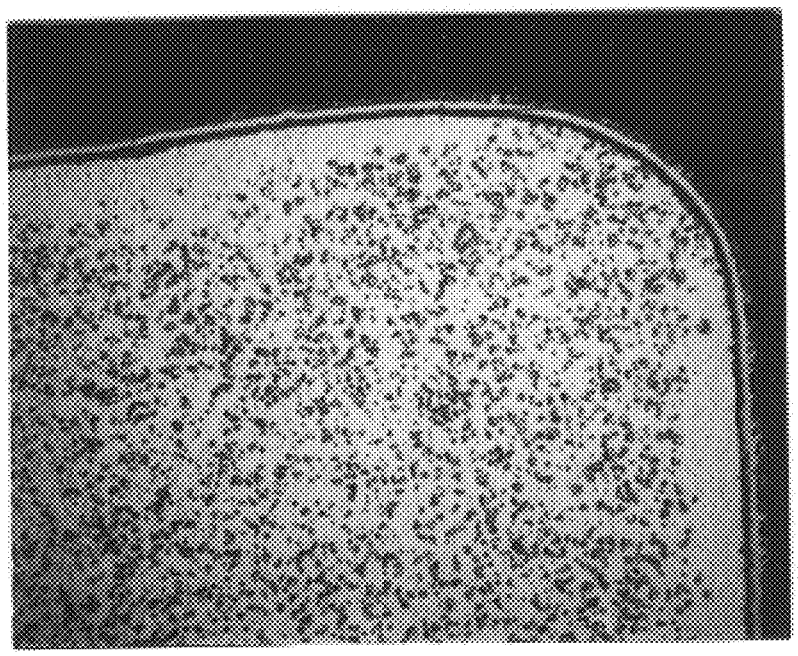
FIG. 3A PRIOR ART
FIG. 3A is a structural photograph showing a section in an insert edge portion of a conventional coated cemented carbide member.
Figure 3B:
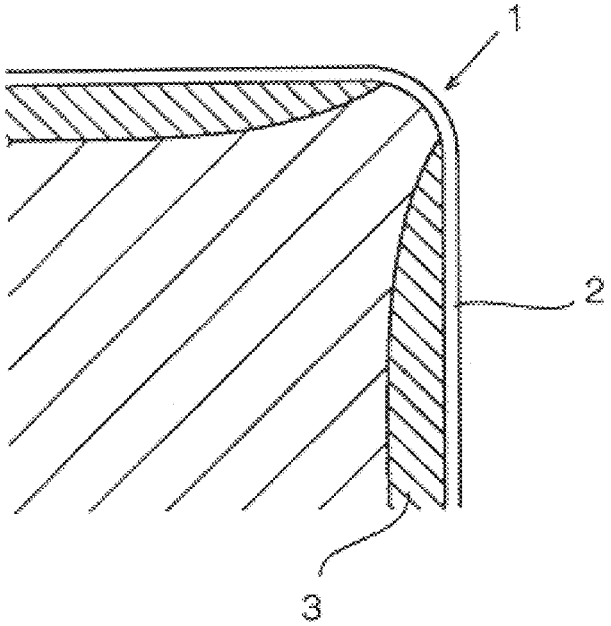
FIG. 3B PRIOR ART
FIG. 3B is a model diagram thereof.

As to these samples, sectional structures in the insert edge portions 1 shown in FIG. 1 were analyzed to obtain the following results:

FIGS. 2A and 2B show such a sectional structure in the sample A, while FIGS. 3A and 3B show that in the sample D. FIGS. 2A and 3A are structural photographs, and FIGS. 23 and 3B are model diagrams thereof respectively. The coating layer comprising the inner layer and the outer layer is indicated as a single layer with a reference number "2" in each of FIGS. 2B and 3B. It is understood from the model diagrams shown in FIGS. 2B and 3B that the insert edge portion 1 was also provided with a β free layer 3 in the sample A, while that of the sample D was provided with no such β free layer. Table 1 also shows thicknesses a of β free layers provided on flat portions of the respective samples, thicknesses b of those provided on insert edge portions (as to a and b, refer to FIG. 2B) and ratios b/a therebetween.

TABLE 1

| Sample | Composition | a: Thickness of β Free Layer on Flat Portion ($\mu$m) | b: Thickness of β Free Layer on Insert Edge Portion ($\mu$m) | Ratio b/a |
|---|---|---|---|---|
| A | WC-4% ZrN-6% Co | 40 | 25 | 0.63 |
| B | WC-8% ZrCN-4% TaC-6% Co | 30 | 20 | 0.67 |
| C | WC-4% HfN-6% Co | 40 | 25 | 0.63 |
| D | WC-2% TiCN-4% TaC-6% Co | 25 | 0 | 0 |

A to C: Inventive Samples
D: Comparative Sample

The samples A to D were subjected to evaluation of cutting performance. Cutting conditions for the evaluation tests and the results thereof are as follows:

Cutting Conditions 1 (Wear Resistance Test)
Cutting Speed: 300 m/min.
Workpiece: SCM415
Feed Rate: 0.4 mm/rev.
Cutting Time: 30 min.
Depth of Cut: 2.0 mm
Cutting Oil: water-soluble Cutting Conditions 2 (Chipping Resistance Test)
Cutting Speed: 100 m/min.
Workpiece: SCM435 (four-grooved material)
Feed Rate: 0.2 to 0.4 mm/rev.
Cutting Time: 30 sec.
Depth of Cut: 2.0 mm repeated eight times

TABLE 2

| Sample | Flank Wear under Cutting Condition 1 (mm) | Chipping Rate under Cutting Condition 2 (%) |
|---|---|---|
| A | 0.185 | 25 |
| B | 0.170 | 35 |
| C | 0.172 | 22 |
| D | 0.225 | 80 |

As clearly understood from the above test results, the sample D having no β free layer in each insert edge portion 1 was inferior to the other samples in both of flank wear and chipping rate.

EXAMPLE 2

Grade powder materials having compositions E to K (wt. %) shown in Table 3 were employed to form coated cemented carbide samples. Shapes of tips, sintering conditions, honing conditions for insert edge portions 1 and thicknesses of coating layers 2 were similar to those in Example 1. Table 3 also shows thicknesses of β free layers provided on flat portions and the insert edge portions (a and b) in the respective samples and ratios (b/a) therebetween.

TABLE 3

| Sample | Composition | a: Thickness of β Free Layer on Flat Portion (μm) | b: Thickness of β Free Layer on Insert Edge Portion (μm) | Ratio b/a |
|---|---|---|---|---|
| E | WC-4% HfC-2% HfCN-6% Co | 5 | 0.5 | 0.1 |
| F | WC-2% ZrC-4% TiN-6% Co | 50 | 70 | 1.4 |
| G | WC-2% ZrCNO-2% HfCNO-6% Co | 5 | 1 | 0.2 |
| H | WC-2% ZrCN-4% NbC-6% Co | 4 | 0.4 | 0.1 |
| I | WC-6% ZrN-6% Co | 55 | 55 | 1.0 |
| J | WC-4% HfC-2% HfCN-6% Co | 5 | 0.4 | 0.08 |
| K | WC-2% ZrC 4% TiN-6% Co | 50 | 75 | 1.5 |

E to K: Inventive Samples

The above samples E to K were subjected to evaluation of cutting performance. Cutting conditions for the evaluation tests are as follows:

Cutting Conditions 3 (Wear Resistance Test)
Cutting Speed: 220 m/min.
Workpiece: SCM435
Feed Rate: 0.4 mm/rev.
Cutting Time: 20 min.
Depth of Cut: 2.0 mm
Cutting Oil: water-soluble Cutting Conditions 4 (Chipping Resistance Test)
Cutting Speed: 100 m/min.
Workpiece: SCM 435 (four-grooved material)
Feed Rate: 0.2 to 0.4 mm/rev.
Cutting Time: 30 sec.
Depth of Cut: 2.0 mm repeated eight times
Table 4 shows the results of the evaluation tests.

TABLE 4

| Sample | Flank Wear under Cutting Conditions 3 (mm) | Chipping Rate under Cutting Conditions 4 (%) |
|---|---|---|
| E | 0.165 | 35 |
| F | 0.185 | 10 |
| G | 0.172 | 24 |
| H | 0.165 | 75 |
| I | 0.210 | 10 |
| J | 0.163 | 78 |
| K | 0.210 | 8 |
| D (Comparative Sample) | 0.235 | 80 |

As understood from the above test results, the inventive samples E to K were improved in balance between wear resistance and chipping resistance as compared with the comparative sample D having no β free layer 3 on each insert edge portion 1. The chipping rate was slightly increased in the sample H since the β free layers 3 were relatively small in thickness on both of the flat and insert edge portions, while that of the sample J was also slightly increased since the β free layer 3 provided on each insert edge portion 1 was slightly smaller in thickness than that provided on each flat portion. On the other hand, wear resistance was slightly deteriorated in the sample I since the β free layers 3 were relatively large in thickness on both of the flat and edge portions, while that of the sample K was also slightly deteriorated since the β free layer provided on each insert edge portion 1 was large in thickness. However, these inventive samples H to K were also sufficiently improved in balance between wear resistance and chipping resistance as compared with the comparative sample D.

EXAMPLE 3

Grade powder materials having compositions (wt. %) shown in Table 5 were previously formed to have curved surfaces in insert edge portions 1 by die pressing and sintered so that boating layers 2 were then provided on base material surfaces of the as-formed sintered bodies, to form coated cemented carbide samples. Shapes of the tips, sintering conditions, and compositions and thicknesses of the coating layers 2 were similar to those of Examples 1 and 2. Table 5 also shows thicknesses of β free layers 3 provided on flat and insert edge portions (a and b) of samples L and M and ratios (b/a) therebetween.

TABLE 5

| Sample | Composition | a: Thickness of β Free Layer on Flat Portion (μm) | b: Thickness of β Free Layer on Insert Edge Portion (μm) | Ratio b/a |
|---|---|---|---|---|
| L | WC-4% HfN-2% TiC-6% Co | 30 | 40 | 1.3 |
| M | WC-4% TiN-4% TiC-6% Co | 25 | 0 | 0 |

L: Inventive sample
M: Comparative sample

These samples L and M were also subjected to evaluation of cutting performance. Cutting conditions for the evaluation tests were similar to the cutting conditions 3 and 4 of Example 2. Table 6 shows the results of the evaluation tests.

TABLE 6

| Sample | Flank Wear under Cutting Condition 3 (mm) | Chipping Rate (%) |
|---|---|---|
| L | 0.175 | 20 |
| M | 0.180 | 90 |

As understood from the results of evaluation shown in Table 6, the samples L and M were equivalent in wear resistance to each other. However, it was confirmed that the sample M was extremely inferior in chipping rate to the sample L. The sample M was deteriorated in chipping rate since its hard phase contained no metal component selected from carbides, nitrides, carbo-nitrides, of Zr and/or Hf.

EXAMPLE 4

Grade powder having a composition of WC - 2% ZrN - 4% TiC - 6% Co was employed to form a tip having the shape of CNMG120408 under ISO standards by previously chamfering each insert edge portion 1 at an angle of 25° in a size of 0.1 mm as viewed from a rake face side by die pressing. Thereafter this tip was heated in a vacuum and held at a temperature of 1400° C. for 1 hour, to form a sintered body. Similarly to Examples 1, 2 and 3, the sintered body serving as a base material was provided with coating layers 2, to form a sample N.

Grade powder of the same composition as the above was formed into a tip having the shape of CNMG120408 under ISO standards, sintered under the same conditions as the sample N, and thereafter each insert edge portion 1 of this sintered body was ground to be chamfered similarly to the above. The sintered body serving as a base material was provided with coating layers 2 similarly to the above, to prepare a sample O.

Figure 4A:
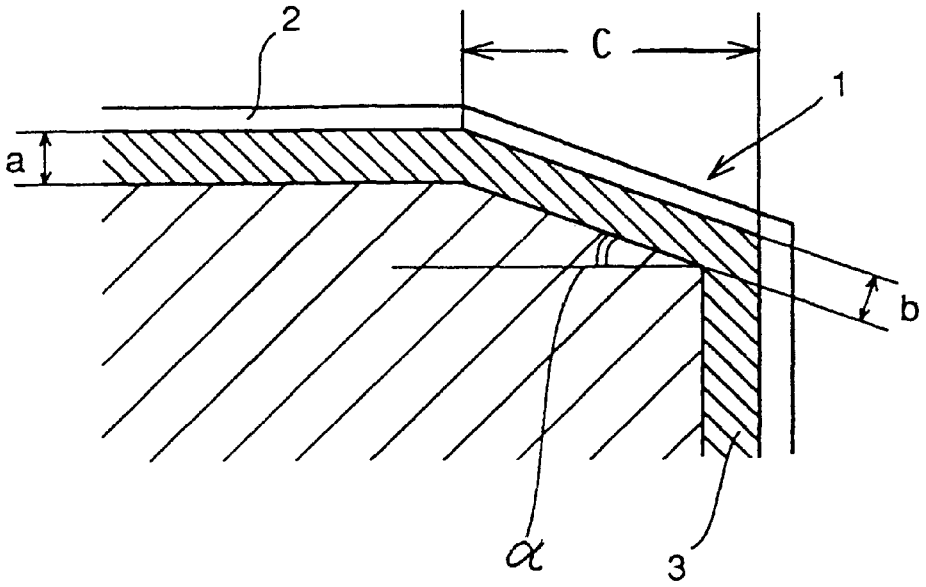
FIG. 4A is a model diagram showing a section in an insert edge portion of a coated cemented carbide member according to another Example of the present invention.
Figure 4B:
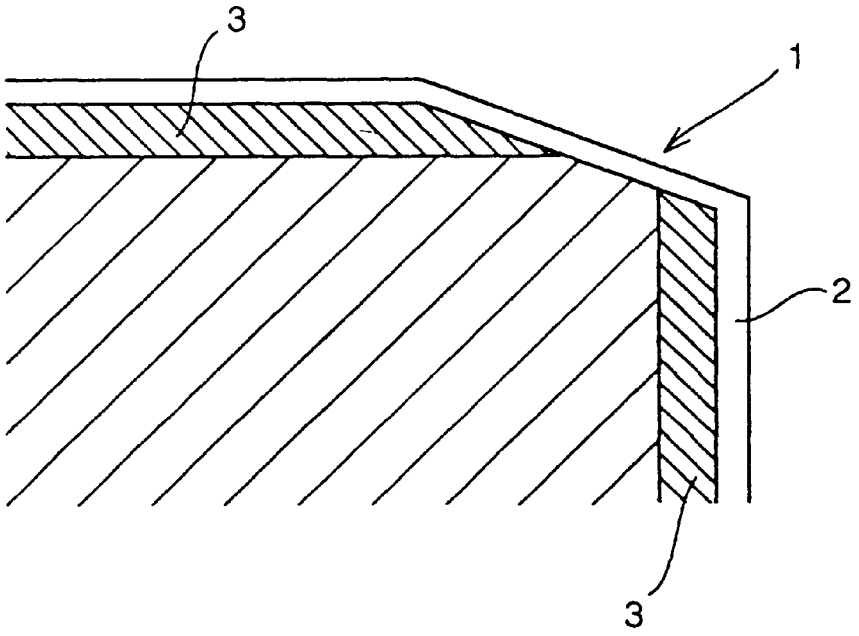
FIG. 4B PRIOR ART
FIG. 4B is a model diagram showing a section in an insert edge portion of a comparative member for that shown in FIG. 4A.

FIGS. 4A and 4B typically illustrate sections in insert edge portions 1 of the samples N and O respectively. Table 7 shows thicknesses of β free layers provided on flat portions and insert edge portions (a and b) of the samples N and O and ratios (b/a) therebetween

TABLE 7

| Sample | a: Thickness of β Free Layer on Flat Portion (μm) | b: Thickness of β Free Layer on Insert Edge Portion (μm) | Ratio b/a |
|---|---|---|---|
| N | 40 | 44 | 1.1 |
| O | 40 | 0 | 0 |

It is understood from FIGS. 4A and 4B that the insert edge portion 1 of the sample N was provided with a β free layer 3 while that of the sample O was provided with no such β free layer 3.

It has been proved by the results of the evaluation tests in Examples 1 to 4 that the following conditions are desirable in order to improve chipping resistance with no deterioration of wear resistance:

(1) The hard phase contains at least one metal component selected from carbides, nitrides, carbo-nitrides and carbonic nitrides of Zr and/or Hf.

(2) The β free layer has a thickness of 5 to 50 μm on each flat portion forming each insert edge portion.

(3) The β free layer provided on each insert edge portion has a thickness of 0.1 to 1.4 times that on each flat portion, i.e., a thickness of 0.5 to 70 μm.

Further Examples of the present invention are now described.

EXAMPLE 5

Grade powder materials having compositions (wt. %) shown in Table 8 were formed into tins each having the shape of CNMG120408 under ISO standards (see FIG. 1), and thereafter these compacts were heated to 1450° C. in a vacuum and held at the temperature for 1 hour, to form sintered bodies. Then insert edge portions 1 of these sintered bodies were honed with a brush employing GC abrasive grains. Thereafter the sintered bodies serving as base materials were coated with inner layers of a carbide, a nitride and a carbo-nitride of Ti having thicknesses of 7 μm in total and outer layers of aluminum oxide,. Table 8 shows thicknesses a of binder phase enriched layers 4 provided on flat portions, thicknesses b of the binder phase enriched layers 4 provided on insert edge portions 1, ratios b/a therebetween and relative weight ratios of Co contained an the interiors in regions immediately under the coating layers 2 in ranges of up to 2 to 50 μm in depth from the base material surfaces. Samples A1 to C1 are inventive samples, and a sample D1 is a conventional sample.

TABLE 8

| Sample | Composition | a: Thickness of Co Enriched Layer on Flat Portion (μm) | b: Thickness of Co Enriched Layer on Insert Edge Portion (μm) | Ratio b/a | Relative Content of Co in Region of 2 to 50 μm in Depth (to Interior) |
|---|---|---|---|---|---|
| A1 | WC-8% ZrN-6% Co | 20 | 28 | 1.4 | 1.5 |
| B1 | WC-4% ZrCN-8% TaC-6% Co | 5 | 7 | 1.4 | 5.0 |
| C1 | WC-16% HfN-6% Co | 100 | 10 | 0.1 | 3.5 |
| D1 | WC-2% TiCN-4% TaC-6% Co | 20 | 0 | 0 | 1.0 |

A1 to C1: Inventive Samples
D1: Conventional Sample

The respective samples were subjected to evaluation of cutting performance under conditions similar to the cutting conditions 1 and 2 in Example 1. Table 9 shows the results of the evaluation tests.

TABLE 9

| Sample | Flank Wear under Cutting Condition 1 (mm) | Chipping Rate under Cutting Conditions 2 (%) |
|---|---|---|
| A1 | 0.170 | 45 |
| B1 | 0.172 | 30 |
| C1 | 0.180 | 22 |
| D1 | 0.225 | 80 |

As clearly understood from the above results of evaluation, it was confirmed that the samples A1 to C1 were slightly superior in wear resistance and remarkably superior in chipping resistance to the sample D1 having no binder phase enriched layer on each insert edge portion 1.

EXAMPLE 6

Grade powder materials having compositions (wt. %) shown in Table 10 were employed to form coated cemented carbide samples. Shapes of the tips, sintering conditions, honing conditions for insert edge portions 1, and compositions and thicknesses of coating layers 2 were similar to those in Example 1.

Table 10 also shows thicknesses of low hardness layers provided on insert edge portions 1 of the respective samples, levels of hardness in the vicinity of the cemented carbide base material surfaces (insert edge portions 1) and the interiors thereof, and ratios therebetween.

TABLE 10

| Sample | Composition | Thickness of Low Hardness Layer on Insert Edge Portion (μm) | Hardness of Insert Edge Portion Close to Base Material Surface (kg/mm²)X | Internal Hardness (kg/mm²)Y | Ratio X/Y |
|---|---|---|---|---|---|
| E1 | WC-5% HfC-1% HfCN-6% Co | 2 | 1240 | 1300 | 0.95 |
| F1 | WC-3% ZrC-3% TiN-6% Co | 30 | 1350 | 1500 | 0.9 |
| G1 | WC-2% ZrCNO-2% HfCNO-6% Co | 20 | 1300 | 1550 | 0.84 |
| H1 | W-2% ZrCN-4% NbC-6% Co | 5 | 1350 | 1480 | 0.91 |
| I1 | WC-6% ZrN-4% TiC-6% Co | 50 | 1020 | 1700 | 0.60 |
| J1 | WC-4% TiC-4% HfN-6% Co | 50 | 850 | 1500 | 0.57 |
| K1 | WC-2% TaC 4% TiN-6% Co | 0 | 1350 | 1600 | 0.84 |

E1 to J1: Inventive Samples
K1: Comparative Samples

The respective samples were subjected to evaluation of cutting performance under conditions similar to the cutting conditions 3 and 4 in Example 2. Table 11 shows the results of the evaluation tests.

TABLE 11

| Sample | Flank Wear Under Cutting Conditions 3 (mm) | Chipping Rate Under Cutting Conditions 4 (%) |
|---|---|---|
| E1 | 0.182 | 35 |
| F1 | 0.180 | 40 |
| G1 | 0.176 | 30 |
| H1 | 0.176 | 43 |
| I1 | 0.165 | 10 |
| J1 | 0.215 | 3 |
| K1 | 0.172 | 85 |

As understood from the above results of evaluation, the samples E1 to J1 have better balance between wear resistance and chipping resistance. The sample J1 is a little bit insufficient in wear resistance, however, from the viewpoint of the balance between wear resistance and chipping resistance, the sample J1 is better than sample K1 which has no low hardness layer on each insert edge portion 1.

EXAMPLE 7

Figure 5A:
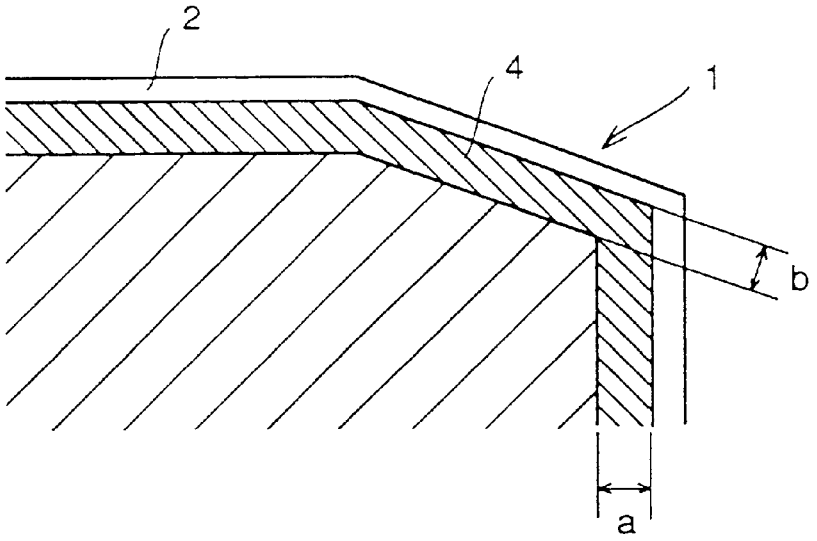
FIG. 5A is a model diagram showing a section in an insert edge portion of a coated cemented carbide member according to still another Example of the present invention.
Figure 5B:
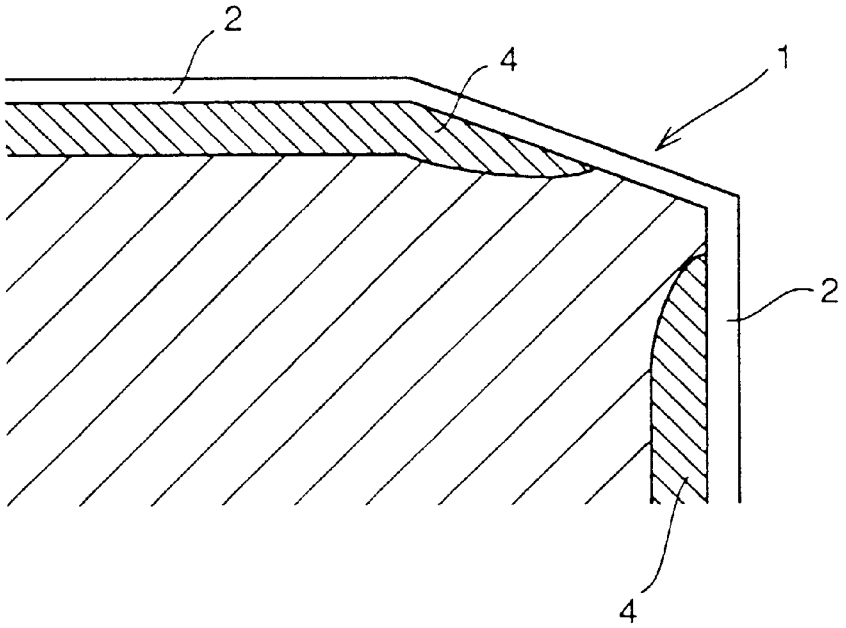
FIG. 5B PRIOR ART
FIG. 5B is a model diagram showing a section in an insert edge portion of a comparative member for that shown in FIG. 5A.

Grade powder materials having compositions (wt. %) shown in Table 12 were previously formed to have chamfered insert edge portions 1 by die pressing sintered and provided with coating layers 2, to prepare coated cemented carbide samples. Shapes of the tips, sintering conditions, and compositions and thicknesses of the coating layers 2 were similar to those in Examples 6 and 7. Table 12 also shows thicknesses a of enriched layers provided on flat portions of samples L1 and M1, thicknesses b of the binder phase enriched layers provided on insert edge portions 1, ratios b/a therebetween, and relative weight ratios of Co with respect to the interiors in regions immediately under the coating layers 2 in ranges of up to 2 to 50 μm in depth from the base material surfaces. FIGS. 5A and 53 typically illustrate sections of the insert edge portions of the samples L1 and M1 respectively. The portions correspond to the binder phase enriched layers and/or low hardness layers are indicated with a reference number "4" in FIGS. 5A and 5B.

TABLE 12

| Sample | Composition | a: Thickness of Co Enriched Layer on Flat Portion (μm) | b: Thickness of Co Enriched Layer on Insert Edge Portion (μm) | Ratio b/a | Relative Content of Co in Region of 2 to 50 μm in Depth (to Interior) |
|---|---|---|---|---|---|
| L1 | WC-6% HfN-4% TiC-6% Co | 30 | 35 | 1.2 | 1.5 |
| M1 | WC-6% TiN-4% TiC-6% Co | 25 | 0 | 0 | 0.9 |

L1: Inventive Sample
M1: Conventional Sample

These samples L1 and M1 were also subjected to evaluation of cutting performance under conditions similar to the cutting conditions 3 and 4 in Example 2. Table 13 shows the results of the evaluation tests.

TABLE 13

| Sample | Flank Wear under Cutting Conditions 3 (mm) | Chipping Rate under Cutting Conditions 4 (%) |
|---|---|---|
| L1 | 0.175 | 20 |
| M1 | 0.178 | 75 |

It is understood from the above results of evaluation that the samples L1 and M1 were substantially equivalent in wear resistance to each other, while it was confirmed that the sample M1 was extremely inferior in chipping rate to the sample L1. This is because a hard phase of the sample M1 contained no metal component selected from carbides, nitrides, carbo-nitrides, Zr and/or Hf.

It was proved from the results of the evaluation tests in Examples 5 to 7 that the following conditions are desirable in order to improve chipping resistance with no deterioration of wear resistance:

(1) The hard phase contains at least one metal component selected from carbides, nitrides, carbo-nitrides and carbonic nitrides of Zr and/or Hf.

(2) The binder phase enriched layer or the low hardness layer has a thickness of 5 to 100 μm on each flat portion forming each insert edge portion.

(3) The binder phase enriched layer or the low hardness layer provided on each insert edge portion has a thickness of 0.1 to 1.4 times that on the flat portion, i.e., a thickness of 0.5 to 140 μm.

(4) The amount of the iron family metal contained in the region immediately under the coating layer in a range of up to 2 to 50 μm in depth from the base material surface is 1.5 to 5 times that in the interior in weight ratio.

(5) Internal hardness of the cemented carbide is 1300 to 1700 kg/mm$^2$ in Vickers hardness with a load of 500 g, and that of the low hardness layer provided on each insert edge portion is 0.6 to 0.95 times the internal hardness.

Further Examples of the present invention are now described.

EXAMPLE 8

Samples having compositions shown in Table 14 were formed into tips each having the shape of CNMG120408 under ISO standards, and thereafter held in a vacuum at 1450° C. for 1 hour to be sintered. Thereafter insert edge portions 1 of the sintered bodies were honed with a brush employing GC abrasive grains, to have curved surfaces. The as-formed sintered bodies sensing as base materials were coated with inner layers of a carbide, a nitride and a carbo-nitride of Ti having thicknesses of 7 μm in total and outer layers of aluminum oxide of 1 μm in thickness.

A base material having the same composition as that of the sample A2 was coated with an inner layer of $TiCl_4$, $CH_3CN$ and $H_2$ having a thickness of 7 μm by MT-CVD at 950° C. and thereafter coated with an outer layer of aluminum oxide of 1 μm in thickness, to prepare a sample A3.

TABLE 14

| Sample | Composition |
|---|---|
| A2, A3 | WC-3 wt % ZrCN-4 wt % NbC-6 wt % Co |
| B2 | WC-3 wt. % ZrCN-4 wt % NbC-6 wt % Co |
| C2 | WC-3 wt % HfCN-2 wt % TaC-6 wt % Co |
| D2 (Conventional Sample) | WC-3 wt % TiCN-2 wt % TaC-6 wt % Co |

The aforementioned samples were analyzed to find that η phases were precipitated on insert edge portions 1 of the samples A2, B2 and C2 in thicknesses of 0.5 to 2 μm while no such η phase was precipitated on each insert edge portion 1 of the sample A3.

Each sample had a β free layer 3, a binder phase enriched layer 4 and a low hardness layer 4 of the same thicknesses. Such thicknesses were 20 μm in the samples A2 and A3, 25 μm in the sample B2 and 30 μm in the sample C2 respectively. Table 15 shows the amounts and hardness levels of metals belonging to the group 5*a* of the periodic table contained in portions inside surface layer regions of these samples.

TABLE 15

| Sample | Content of Carbo-Nitride of Group 5a Metal in Portion inside Surface Layer Region (to Interior) | Content of Carbo-Nitride of Zr of Hf in Portion inside Surface Layer Region (to Interior) | Thickness of High Hardness Layer inside Surface Layer Region | Maximum Hardness of High Hardness Layer inside Surface Layer Region |
|---|---|---|---|---|
| A2 | 2.5 Times | 1.0 | 160 | 1700 |
| B2 | 1.8 Times | 1.0 | 100 | 1650 |
| C2 | 1.2 Times | 1.05 | 40 | 1550 |

The aforementioned samples, including the conventional sample D2 for comparison, were subjected to evaluation of cutting performance under the following conditions:

Cutting Conditions 5 (Wear Resistance and Plastic Deformation Resistance Tests)
- Cutting Speed: 150 m/min.
- Workpiece: SK5
- Feed Rate: 0.7 mm/rev.
- Cutting Time: 5 min.
- Depth of Cut: 2.0 mm
- Cutting Oil: water-soluble Cutting Conditions 6 (Chipping Resistance Test)
- Cutting Speed: 100 m/min.
- Workpiece: SCM435
- Feed Rate: 0.2 to 0.4 mm/rev.
- Chatting Time: 30 sec.
- Depth of Cut: 2.0 mm repeated eight times Table 16 shows the results of the aforementioned evaluation tests.

TABLE 16

| Sample | Flank Wear (mm) | Plastic Deformation (mm) | Chipping Rate (%) |
|---|---|---|---|
| A2 | 0.14 | 0.055 | 25 |
| A3 | 0.11 | 0.054 | 18 |
| B2 | 0.16 | 0.079 | 20 |
| C2 | 0.18 | 0.090 | 10 |
| D2 | 0.28 | 0.145 | 90 |

It is understood from the above results of evaluation that the inventive samples A2, B2 and C2 were extremely superior to the comparative sample D2 not only in wear resistance and plastic deformation resistance but in chipping resistance. Further, the sample A3 was further superior to the sample A2 in wear resistance and chipping resistance. This is conceivably because each insert edge portion 1 of the sample A3 was provided with no η phase.

EXAMPLE 9

Raw powder materials were prepared from WC of 4 μm in grain size, ZrC of 1 to 2 μm in grain size, ZrN, HfC, HfN, (Zr, Hf)C (in a composition of 50 mol % ZrC), (Zr, W)C (in a composition of 90 mol % ZrC), (Hf, W)C (in a composition of 90 mol % HfC), Co and Ni respectively. These raw powder materials were wet-blended with each other to form grade powder materials having compositions shown in Table 17. The grade powder materials were press-molded into tips each having the shape of CNMG120408 under ISO standards, and thereafter heated in an $H_2$ atmosphere to a temperature of 1000° to 1450° C. at a rate of 5° C./min. The tips were then held in a vacuum at 1450° C. for 1 hour, and cooled.

TABLE 17

| No. | Wt. % ZrC | ZrN | HfC | HfN | (ZrHf)C | (ZrW)C | (HfW)C | Wt. % Co | Ni | WC | Thickness of Layer A |
|---|---|---|---|---|---|---|---|---|---|---|---|
| | | | | | Inventive Samples | | | | | | |
| 1 | 0.3 | | | | | | | 2 | | Residue | 0 |
| 2 | 2 | | | | | | | 6 | | Residue | 0 |
| 3 | 4 | | | | | | | 6 | | Residue | 5 |
| 4 | | | | | | 4.8 | | 6 | | Residue | 5 |
| 5 | | 2 | | | | | | 6 | | Residue | 15 |
| 6 | | 4 | | | | | | 6 | | Residue | 30 |
| 7 | | 8 | | | | | | 6 | | Residue | 50 |
| 8 | | | | | 10 | | | 6 | | Residue | 10 |
| 9 | 3.5 | | 6.5 | | | | | 6 | | Residue | 10 |
| 10 | | 10 | | 5 | | | | 6 | | Residue | 100 |
| 11 | | | 8 | | | | | 13 | 2 | Residue | 10 |
| 12 | | | | | | | 8.9 | 13 | 2 | Residue | 10 |
| | | | | | Comparative Samples | | | | | | |
| 13 | 0.3 | | | | | | | 1.5 | | Residue | 0 |
| 14 | | 11 | | 6 | | | | 6 | | Residue | 110 |
| 15 | | | 8 | | | | | 13 | 3 | Residue | 0 |
| 16 | WC-2 wt % Co | | | | | | | | | Residue | 0 |
| 17 | WC-2 wt % TiN-2 wt % TaC-6 wt % Co | | | | | | | | | Residue | 20 |

Then the as-formed sintered bodies serving as base materials were subjected to cutting edge processing, and coated with inner layers of TiC having thicknesses of 5 $\mu$m and outer layers of aluminum oxide having thicknesses of 1 $\mu$m, to be subjected to cutting tests under the following ting conditions:

Cutting Conditions 7 (Wear Resistance Test)
Cutting Steed: 350 m/min.
Workpiece: SCM415
Feed Rate: 0.5 mm/rev.
Cutting Time: 20 min.
Depth of Cut: 2.0 mm Cutting Conditions 8 (Toughness Test)
Cutting Speed: 100 m/min.
Workpiece: SCM435 (four-grooved material)
Feed Rate: 0.20 to 0.40 mm/rev.
Cutting Time: 30 sec.
Depth of Cut: 2.0 mm repeated eight times Table 18 shows the results of the cutting tests. These samples included those having hard phase disappearance layers on base material surfaces and those having no such layers. Such hard phase disappearance layers are expressed as layers A. Thicknesses of such layers A are shown in the rightmost column of Table 17.

TABLE 18

| | No. | Test 7 (Flank Wear) | Test 8 (Chipping Rate) |
|---|---|---|---|
| Inventive Samples | 1 | 0.20mm | 60% |
| | 2 | 0.24 | 45 |
| | 3 | 0.22 | 40 |
| | 4 | 0.21 | 36 |
| | 5 | 0.25 | 24 |
| | 6 | 0.23 | 18 |
| | 7 | 0.21 | 10 |
| | 8 | 0.16 | 43 |
| | 9 | 0.17 | 47 |
| | 10 | 0.24 | 60 |
| | 11 | 0.25 | 40 |
| | 12 | 0.23 | 35 |

TABLE 18-continued

| | No. | Test 7 (Flank Wear) | Test 8 (Chipping Rate) |
|---|---|---|---|
| Comparative Samples | 13 | 0.28 | 95 |
| | 14 | 0.28 | 80 |
| | 15 | 0.30 | 20 |
| | 16 | 0.21 | 80 |
| | 17 | 0.24 | 75 |

EXAMPLE 10

Raw powder materials were prepared from WC of 4 $\mu$m in grain size, ZrN of 1 to 2 $\mu$m in grain size, HfN, (Zr, Hf)C (in a composition of 50 mol % ZrC), TiC, TiN, TaC, NbC, (Ti, W)CN (in a composition of 30 wt. % TiC and 25 wt. % TiN with a remainder of WC), (Hf, W)CN (in a composition of 90 mol % HfCN with a remainder of WC), (Ti, Hf)C (in a composition of 50 mol % TiC), Co and Ni respectively to form grade powder materials having compositions shown in Table 19, similarly to Example 9. These grade powder materials were press-molded into tips each having the shape of CNMG120408 under ISO standards, and thereafter heated in an $H_2$ atmosphere to a temperature of 1000° to 1450° C. at a rate of 5° C./min. The tips were held in a vacuum at 1450° C. for 1 hour, and thereafter cooled. Then the as-formed sintered bodies serving as base materials were subjected to cutting edge processing, and coated with inner layers of TiC having thicknesses of 5 $\mu$m and outer layers of aluminum oxide having thicknesses of 1 $\mu$m by ordinary CVD, to form inventive samples 18 to 25 shown in Table 19. Samples 26 to 34 are comparative samples having compositions out of the inventive composition range.

TABLE 19

Inventive Samples

| No. | Wt. % ZrN | HfN | (ZrHf)C | TiC | TaC | NbC | TiN | (TiW)CN | Wt. % Co | Ni | WC | Thickness of Layer A (μm) |
|---|---|---|---|---|---|---|---|---|---|---|---|---|
| 18 | | | 0.3 | 15 | 10 | 10 | | | 2 | | Residue | 0 |
| 19 | 2 | | | 2 | | | | | 6 | | Residue | 15 |
| 20 | | 4 | | | 2 | | | | 6 | | Residue | 30 |
| 21 | 4 | | | | | | 0.03 | | 6 | | Residue | 35 |
| 22 | | 1 | | 1 | | | | | 6 | | Residue | 5 |
| 23 | 8 | | | | 2 | | | | 6 | | Residue | 50 |
| 24 | | | 15 | | | | | 5 | 6 | | Residue | 100 |
| 25 | | 4 | | | 2 | | | | 10 | 5 | Residue | 30 |

Comparative Samples

| No. | Wt. % ZrN | HfN | (ZrHf)C | TiC | TaC | NbC | TiN | (TiW)CN | Wt. % Co | Ni | WC | Thickness of Layer A (μm) |
|---|---|---|---|---|---|---|---|---|---|---|---|---|
| 26 | | | 0.3 | 15 | 15 | 5 | | | 1.5 | | Residue | 0 |
| 27 | | | 0.3 | 26 | 10 | | | | 2 | | Residue | 0 |
| 28 | | | 16 | | | | | 4 | 6 | | Residue | 110 |
| 29 | | 4 | | | 2 | | | | 10 | 6 | Residue | 30 |
| 30 | WC-15 wt % TiCN-1 wt % TaC-10 wt % NbC-2 wt % Co | | | | | | | | 6 | | Residue | 0 |
| | WC-4 wt % TiN-2 wt % TaC-6 wt % Co | | | | | | | | 13 | 3 | Residue | 30 |

| No. | Wt. % (Zrw)CN | (HfW)CN | (TiW)CN | TiC | (T1Hf)C | TaC | Wt. % Co | Ni | WC | Thickness of Layer A |
|---|---|---|---|---|---|---|---|---|---|---|
| 26 | 2.4 | | 3.6 | | | | 6 | | Residue | 20 |
| 27 | | 4.5 | | | | 2 | 6 | | Residue | 30 |
| 28 | | | | 0.7 | 1.3 | | 6 | | Residue | 5 |

The respective samples shown in Table 19 were subjected to wear resistance and toughness tests under the following cutting conditions:

Cutting Conditions 9 (Wear Resistance Test)
- Cutting Speed: 160 m/min.
- Workpiece: SCM415
- Feed Rate: 0.5 mm/rev.
- Cutting Time: 40 min.
- Depth of Cut: 1.5 mm Cutting Conditions 10 (Toughness Test)
- Cutting Speed: 100 m/min.
- Workpiece: SCM435 (four-grooved material)
- Feed Rate: 0.15 to 0.25 mm/rev.
- Cutting Time: 30 sec.
- Depth of Cut: 2.0 mm repeated eight times Table 20 shows the results of the evaluation tests.

TABLE 20

| | No. | Test 9 (Flank Wear) | Test 10 (Chipping Rate) |
|---|---|---|---|
| Inventive Samples | 18 | 0.18mm | 60% |
| | 19 | 0.20 | 35 |
| | 20 | 0.21 | 25 |
| | 21 | 0.22 | 28 |
| | 22 | 0.24 | 48 |
| | 23 | 0.20 | 22 |
| | 24 | 0.24 | 14 |
| | 25 | 0.24 | 35 |
| | 32 | 0.20 | 32 |
| | 33 | 0.20 | 22 |
| | 34 | 0.23 | 42 |

TABLE 20-continued

| | No. | Test 9 (Flank Wear) | Test 10 (Chipping Rate) |
|---|---|---|---|
| Comparative Samples | 26 | 0.30 | 95 |
| | 27 | 0.17 | 74 |
| | 28 | 0.28 | 45 |
| | 29 | 0.28 | 33 |
| | 30 | 0.24 | 90 |
| | 31 | 0.28 | 88 |

EXAMPLE 11

Figure 6:
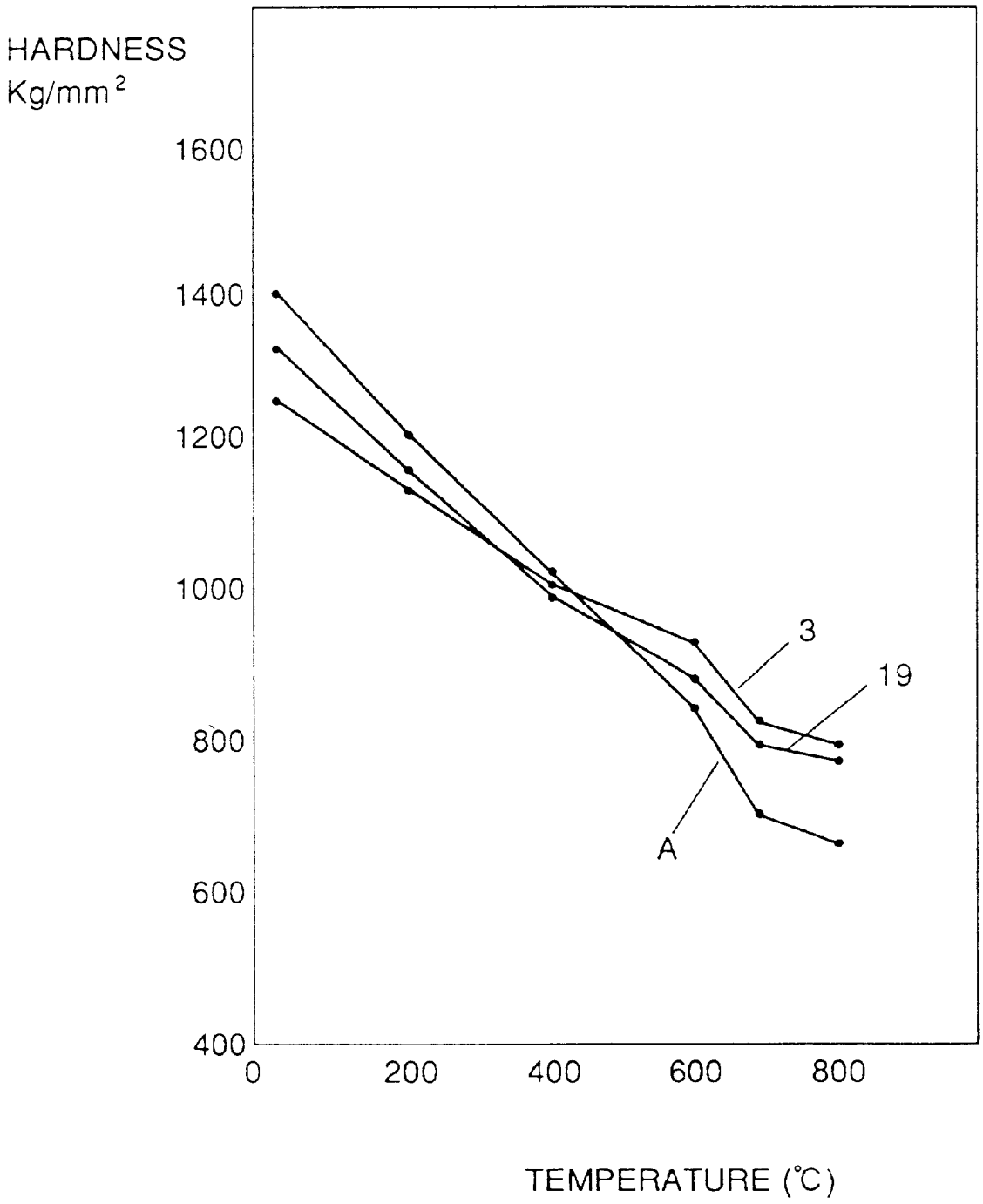
FIG. 6 is a graph showing relations between Vickers hardness levels and temperatures of two types of coated cemented carbide members according to further Example of the present invention and a conventional coated cemented carbide member.

The samples Nos. 3 and 19 shown in Tables 17 and 19 according to Examples 9 and 10 were subjected to measurement of transverse rupture strength under the room temperature and a high temperature and high-temperature hardness. The hardness levels were measured under loads of 5 kg. Table 21 and FIG. 6 show the results, with the results of the comparative sample 17 in Table 17. It is understood from these results that the inventive samples 3 and 19 were superior to the comparative sample 17 in transverse rupture strength and hardness under high temperatures.

TABLE 21

| | No. | Transverse Rupture Strength at Room Temperature | Transverse Rupture Strength at 1000° C. |
|---|---|---|---|
| Inventive Samples | 3 | 252 kg/mm$^2$ | 92 kg/mm$^2$ |
| | 19 | 216 | 88 |
| Comparative Samples | 17 | 190 | 80 |

The following Table 22 lists all of the above samples that have a hard phase consisting of WC and at least one of carbides, nitrides, carbonitrides or carbonic nitrides of HF and/or Zr and solid solutions thereof, and that have a surface layer flat portion thickness (a) in the range from 5 $\mu$m to 100 $\mu$m and a ratio of the edge portion thickness to the flat portion thickness (b/a) in the range from 0.1 to 1.4. Table 22 recites the composition, flat portion thickness (a), the thickness ratio (b/a), and the cutting test results for each sample as reported above. The cutting test results are for above cutting conditions 2 or 4, whereby a "0" symbol indicates a chipping rate of not more than 50% and a Δ symbol indicates a chipping rate of more than 50%. Table 22 also shows the total percentage content (W) of nitrides, carbonitrides, and carbonic nitrides of Zr and/or Hf relative to the total composition, and the weight ratio of Zr and Hf relative to the amount of binder phase ((Zr+Hf)/Co) in each sample.

TABLE 22

| Sample | Composition | w (wt. %) | a ($\mu$m) | b/a | (Zr + Hf)/Co | Cutting Test Results |
|---|---|---|---|---|---|---|
| Table 1 A | WC-4% ZrN-6% Co | 4 | 40 | 0.63 | 0.58 | ○ |
| Table 1 C | WC-4% HfN-6% Co | 4 | 40 | 0.63 | 0.62 | ○ |
| Table 3 E | WC-4% HfC-2% HfCN-6% Co | [6] 2 | 5 | 0.1 | 0.94 | ○ |
| Table 3 G | WC-2% ZrCNO-2% HfCNO-6% Co | 4 | 5 | 0.2 | 0.60 | ○ |
| Table 3 I | WC-6% ZrN-6% Co | 6 | 55 | 1.0 | 0.87 | ○ |
| Table 8 A1 | WC-8% ZrN-6% Co | 8 | 20 | 1.4 | 1.16 | ○ |
| Table 8 C1 | WC-16% HfN-6% Co | 16 | 100 | 0.1 | 2.47 | ○ |
| Table 3 H* | WC-2% ZrCN-2% NbC-6% Co | 2 | 4 | 0.1 | 0.29 | Δ |
| Table 3 J* | WC-4% HfC-2% HfCN-6% Co | [6] 2 | 5 | 0.08 | 0.94 | Δ |

*comparative samples; underlined value is out of inventive range--.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A coated cemented carbide member comprising a cemented carbide base material consisting of a binder phase and a hard phase, and having an outer surface with an edge portion and a flat surface portion, wherein said binder phase consists of at least one iron family metal, and said hard phase consists of WC and at least one component selected from the group consisting of carbides, nitrides, carbonic nitrides and carbo-nitrides of Zr and/or Hf, and a solid solution thereof, wherein said base material comprises a surface layer consisting only of WC and an iron family metal disposed at said flat surface portion and said edge portion, and wherein said surface layer has a flat portion thickness in the range from 5 $\mu$m to 100 $\mu$m at said flat surface portion and an edge portion thickness of 0.1 to 1.4 times said flat portion thickness at said edge portion, and wherein the weight ratio of Zr and Hf in said at least one component relative to said binder phase is within the range represented as:

$$0.58 \leqq (Zr+Hf)/\text{binder phase} \leqq 2.47.$$

2. The coated cemented carbide member of claim 1, wherein said outer surface of said base material comprises a plurality of said flat surface portions, with said edge portion formed at an intersection of two adjacent ones of said flat surface portions, and wherein said surface layer is disposed substantially parallel to said flat surface portions even at said edge portion.

3. A coated cemented carbide member comprising a cemented carbide base material consisting of a binder phase and a hard phase, and having an outer surface with an edge portion and a flat surface portion, wherein said binder phase consists of at least one iron family metal, and said hard phase consists of WC and at least one component selected from the group consisting of carbides, nitrides, carbonic nitrides and carbo-nitrides of Zr and/or Hf, and a solid solution thereof, wherein said base material comprises an internal core and a surface layer that contains a larger proportion of said binder phase than does said internal core and that is disposed at said flat surface portion and said edge portion, and wherein said surface layer has a flat portion thickness in the range from 5 $\mu$m to 100 $\mu$m at said flat surface portion and an edge portion thickness of 0.1 to 1.4 times said flat portion thickness at said edge portion, and wherein the weight ratio of Zr and Hf in said at least one component relative to said binder phase is within the range represented as:

$$0.58 \leqq (Zr+Hf)/\text{binder phase} \leqq 2.47.$$

4. The coated cemented carbide member of claim 3, wherein said outer surface of said base material comprises a plurality of said flat surface portions, with said edge portion formed at an intersection of two adjacent ones of said flat surface portions, and wherein said surface layer is disposed substantially parallel to said flat surface portions even at said edge portion.

5. A coated cemented carbide member comprising a cemented carbide base material consisting of a binder phase and a hard phase, and having an outer surface with an edge portion and a flat surface portion, wherein said binder phase consists of at least one iron family metal, and said hard phase consists of WC and at least one component selected from the group consisting of carbides, nitrides, carbonic nitrides and carbo-nitrides of Zr and/or Hf, and a solid solution thereof, wherein said base material comprises an internal core and a surface layer that has a lower hardness than said internal core and that is disposed at said flat surface portion and said edge portion, and wherein said surface layer has a flat portion thickness in the range from 5 $\mu$m to 100 $\mu$m at said flat surface portion and an edge portion thickness of 0.1 to 1.4 times said flat portion thickness at said edge portion, and wherein the weight ratio of Zr and Hf in said at least one component relative to said binder phase is within the range represented as:

$$0.58 \leqq (Zr+Hf)/\text{binder phase} \leqq 2.47.$$

6. The coated cemented carbide member of claim 5, wherein said outer surface of said base material comprises a plurality of said flat surface portions, with said edge portion formed at an intersection of two adjacent ones of said flat surface portions, and wherein said surface layer is disposed substantially parallel to said flat surface portions even at said edge portion.

7. A coated cemented carbide member comprising a cemented carbide base material consisting of a binder phase and a hard phase, and having an outer surface with a plurality of flat surface portions and an edge portion formed at an intersection of two adjacent ones of said flat surface portions, wherein said binder phase consists of at least one iron family metal, and said hard phase consists of WC and at least one component selected from the group consisting of carbides, nitrides, carbonic nitrides and carbo-nitrides of Zr and/or Hf, and a solid solution thereof, wherein said base material comprises a surface layer consisting only of WC and an iron family metal disposed substantially parallel to said flat surface portions at said flat surface portions and said edge portion, and wherein said surface layer has a flat portion thickness in the range from 5 $\mu$m to 100 $\mu$m at said flat surface portions and an edge portion thickness of 0.1 to 1.4 times said flat portion thickness at said edge portion, and wherein the total combined weight percentage content of nitrides, carbonic nitrides and carbo-nitrides of Zr and/or Hf included in said at least one component with respect to said base material as a whole is in the range from 2 wt. % to 16 wt. %.

8. The coated cemented carbide member of claim 7, wherein said outer surface of said base material comprises a plurality of said flat surface portions, with said edge portion formed at an intersection of two adjacent ones of said flat surface portions, and wherein said surface layer is disposed substantially parallel to said flat surface portions even at said edge portion.

9. The coated cemented carbide member of claim 7, wherein the weight ratio of said total combined weight percentage content relative to the content of said binder phase is in the range from ⅓ to 2⅔.

10. A coated cemented carbide member comprising a cemented carbide base material consisting of a binder phase and a hard phase, and having an outer surface with a plurality of flat surface portions and an edge portion formed at an intersection of two adjacent ones of said flat surface portions, wherein said binder phase consists of at least one iron family metal, and said hard phase consists of WC and at least one component selected from the group consisting of carbides, nitrides, carbonic nitrides and carbo-nitrides of Zr and/or Hf, and a solid solution thereof, wherein said base material comprises an internal core and a surface layer that contains a larger proportion of said binder phase than does said internal core and that is disposed substantially parallel to said flat surface portions at said flat surface portions and said edge portion, and wherein said surface layer has a flat portion thickness in the range from 5 $\mu$m to 100 $\mu$Mm at said flat surface portions and an edge portion thickness of 0.1 to 1.4 times said flat portion thickness at said edge portion, and wherein the total combined weight percentage content of nitrides, carbonic nitrides and carbo-nitrides of Zr and/or Hf included in said at least one component with respect to said base material as a whole is in the range from 2 wt. % to 16 wt. %.

11. The coated cemented carbide member of claim 10, wherein the weight ratio of said total combined weight percentage content relative to the content of said binder phase is in the range from ⅓ to 2⅔.

12. A coated cemented carbide member comprising a cemented carbide base material consisting of a binder phase and a hard phase, and having an outer surface with a plurality of flat surface portions and an edge portion formed at an intersection of two adjacent ones of said flat surface portions, wherein said binder phase consists of at least one iron family metal, and said hard phase consists of WC and at least one component selected from the group consisting of carbides, nitrides, carbonic nitrides and carbo-nitrides of Zr and/or Hf, and a solid solution thereof, wherein said base material comprises an internal core and a surface layer that has a lower hardness than said internal core and that is disposed substantially parallel to said flat surface portions at said flat surface portions and said edge portion, and wherein said surface layer has a flat portion thickness in the range from 5 $\mu$m to 100 $\mu$m at said flat surface portions and an edge portion thickness of 0.1 to 1.4 times said flat portion thickness at said edge portion, and wherein the total combined weight percentage content of nitrides, carbonic nitrides and carbo-nitrides of Zr and/or Hf included in said at least one component with respect to said base material as a whole is in the range from 2 wt. % to 16 wt. %.

13. The coated cemented carbide member of claim 12, wherein the weight ratio of said total combined weight percentage content relative to the content of said binder phase is in the range from ⅓ to 2⅔.

* * * * *

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Title Page: Col 2, under "FOREIGN PATENT DOCUMENTS",
above line 1, insert --32 11 047 11/1982 Fed. Rep. of Germany--;
line 1, after "5/1984", replace "European Patent Office" by --Europe--;
line 2, after "11/1986", replace "European Patent Office" by --Europe--;
line 3, after "10/1989", replace "European Patent Office" by --Europe--;
line 4, after "9/1993" , replace "European Patent Office" by --Europe--;

under "OTHER PUBLICATIONS",
following line 4, insert the following: --M. Schwarzkopf et al. "Stickstoffhaltige Hartmetalle zur Herstellung Zähigkeitssteigernder Randzonen" ("Nitrogen-Containing Hard Metals for Producing Toughness Enhancing Surface Layers"), published in "Wear Resistant Materials" Proceedings of the 12th International Plansee Seminar, Vol. 2; May 8 to 12, 1989; Pgs. 803-833--;

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 1, line 14, after "and" (second occurrence) insert --to--;
line 23, after "such" delete "a", replace "tool is" by --tools has been--;
line 24, after "is" replace "decided" by --determined--;
line 32, after "improve" insert --the--;
line 38, after "iron" insert --group or--;
line 51, replace "employed" by --known--, after "applied", replace "to" by --as--;
line 53, after "is", replace "caused" by --formed--;
line 54, after "material", replace "in" by --during--;
line 56, after "layer", replace "falls" by --fails--; after "to", replace "cause" by --increase the--;
line 59, after "improve" insert --the--;
line 62, after "insert", insert --when used--; after "under" delete --a--.
line 63, after "speed", replace "condition" by --conditions--;
line 64, after "although" insert --the--.
Col. 2, line 10, after "both", delete "of";
line 11, after "toughness" insert --when used--;
line 15, after "one" replace "iron-family" by --iron group or family--;
line 22, after "carbide", replace "member is provided-on its" by --material includes an--;

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 2, line 23, after "surface" delete "with a";
line 24, after "layer" insert --provided outside the surface layer--;
line 34, after "layer", delete ", provided";
line 36, after "metal" insert --,--;
line 37, after "portion" (first occurrence), replace "forming" by --adjoining--;
line 38, after "portion" (first occurrence), replace "in" by --when measured directly at the corner or edge of--;
line 40, after "the" (third occurrence) insert --surface--;
line 47, after "metal" insert --, or alternatively with a low hardness layer,--;
line 53, after "layer", replace "and" by --or--;
line 58, after "surface", replace "forming" by --meeting to form--;
line 59, after "that", replace "in the flat portion in", by --thickness when measured at the cornered edge of--;

Col. 3, line 1, after "in", replace "a" by ---an enriched layer or--.
line 33, after "portion" insert --,--.
line 39, after "region" insert --or inner layer--;
line 40, after "interior" insert --or internal core--;

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 3, line 41, after "from", delete "the region of";
line 47, after "to", delete "the" (first occurrence);
line 48, after "in" insert --the inner layer over--;
line 49, after "the" (first occurrence), delete "region of the";
line 50, after "interior" insert --or internal core--, after "." insert --Furthermore, the metal component selected from carbides, nitrides and carbo-nitrides of Zr and/or Hf is contained in the inner layer in the same weight ratio as in the interior or internal core.--.
line 51, after "region" insert --or inner layer--, delete "in";
line 52, before "surface", delete "region of";
line 58, after "region" insert --or inner layer--.
line 60, after "is", delete "in a";
line 61, before "less", delete "range of";
line 63, after "although", replace "an effect as to", by --the--,
line 64, after "hardness", replace "is in a range exceeding" by --exceeds--
line 66, after "although", delete "effects as to";

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 4, line 3, after "method", replace ":" by --.--, after "a", delete "coated";
line 5, after "polished", replace "for bevelling in a range for leaving" by --to achieve bevelling to such an extent to still retain--;
line 7, after "the", delete "coated";
line 10, after "." insert --Then a coating material is applied as described below.--;
line 14, after "portion,", replace "there is" by --the invention provides--.
line 24, before "thickness", replace "a" (first occurrence) by --the edge portion--;
line 25, after "layer" (first occurrence) insert --relative--.
line 56, after "resistance", replace ", while it" by --. It--;
line 57, before "a", delete "such", before "the", replace "that" by --wherein--;
line 58, before "with", replace "falls" by --fails--, after "work" insert --thereby leading--; after "to", replace "progress" by --progressive--;
line 59, after "wear,", replace "thereby improving" by --whereby the invention improves--;
line 60, before "such", delete "of";
line 62, after "material,", replace "there is" by --the invention provides--.

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 5, line 1, after "adhesion", replace "(peeling" by --or peeling--,
line 2, after "resistance", delete ")";
line 8, after "the", replace "following" by --below described--;
line 10, after "metals", replace ":" by --.--;
line 19, after "binder", replace "chase" by --phase--;
line 20, after "hard", replace "chase" by --phase--;
line 30, after "at", delete "the";
line 36, after "at", delete "the".
line 56, after "layer", replace "is" by --can be--;
line 62, after "weight,", replace "no sufficient effects are attained as to" by --it is impossible to attain a sufficient improvement in--;
line 63, before "cemented", insert --in--;
line 64, after "and" replace "no-sufficient effect of" by --nor a sufficient --;
line 65, after "life", delete "can be attained";
Col. 6, line 1, after "to" insert --a--.
line 4, before "reduction" insert --a--, after "in" insert --the--;
line 7, after "to" insert --a --; before "plastic" insert --the--;
line 13, after "known" insert --that it is--, after "improve" insert --the--;
line 15, after "thereto", replace "("Powder" by --as discussed in "Powder--;
line 16, before ".", delete ")", after "however," replace "studs" by --the subject of study--;
line 17, after "been", replace "made" by --related--, after "only", delete "in relation";

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 6, line 19, after "phase" insert --,--, before "not", delete "(";
line 21, after "carbide", delete ")";
line 24, before "a", replace "made study as to" by --studied--.
line 25, after "find", delete "that employ-";
line 26, before "a" (first occurrence), replace "ment of" by --for the first time that using--, before "a" (second occurrence), insert --such--,
line 27, after "region", replace "has an effect in" by --achieves an--, after "of", delete "a", after "life", replace "for the first" by --.--;
line 28, cancel the entire line;
line 30, after "consisting" insert --of--;
line 43, after "Ti", replace "(Transactions" by --as described in Transactions--;
line 44, after "example", delete ")".

Col. 7, line 1, after "mentioned" insert --or first--;
line 2, after "further", delete "-"; after "another", delete "-",
line 3, before "hard", insert --or second--.

line 10, after "improve" insert --the--;
line 18, after "conditions", replace "causing no" by --that do not cause an--; after "of", delete "a";
line 20, after "carbide" insert --of metals--;

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 7, line 21, after "those", delete "of metals";
line 26, after "carbide" insert --of metals--, after "those", delete "of" (second occurrence);
line 27, before "," (first occurrence), delete "metals,".
line 32, after "for", replace "restriction of" by --restricting the--.
line 58, before "ISO", replace "under the" by --according to--;
line 59, after "section", replace "in" by --through--;
line 63, after "section", replace "in" by --through--;
line 66, after "section", replace "in" by --through--;
Col. 8, line 2, after "section", replace "in" by --through--;
line 4, after "section", replace "in" by --through--.
line 7, after "section", replace "in" by --through--;
line 12, after "further", replace "Example" by --Examples--;
line 18, after "invention", replace "are now" by --will now be--;
line 21, after "D", delete "(wt.";
line 22, before "shown", replace "%)" by --of different weight percentages as--, after "into" insert --tool--;
line 23, after "shape", replace "of" by --prescribed as--, replace "," by --. The compositions A to C are according to the invention and composition D is a comparative sample. The sample tool tips were each--;
line 29, after "inner" insert --coating--;

UNITED STATES PATENT AND TRADEMARK OFFICE
CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

| | | |
|---|---|---|
| Col. 8, | line 31, | after "outer" insert --coating--; |
| | line 33, | after "structures", replace "in" by --of--. |
| | line 34, | after "results", replace ":" by --.--; |
| | line 38, | before "and", replace "23" by --2B--; |
| | line 43, | after "portion 1", replace "was also provided with" by --has--; after "3" insert --extending around the edge--; |
| | line 44, | after "D", replace "was provided with" by --has--, |
| | line 45, | after "layer", replace "." by --at the edge. Fig. 2B shows the thickness a of flat surface portions of the β free layers 3, and the thickness b of the edge where two flat portions of the layers 3 meet.--; before "thicknesses" insert --the--; |
| | line 47, | after "portions", delete "(as"; |
| | line 48, | before "and" (**second occurrence**), delete "to a and b, refer to Fig. 2B)". |
| Col. 9, | line 24, | after "the" (**second occurrence**), insert --non-inventive comparative--; |
| | line 29, | after "K", replace "(wt." by --of different weight percentages as--; |
| | line 30, | before "shown", delete "%)"; |
| | line 34, | after "thicknesses" insert --, a and b respectively,--; |
| | line 35, | after "portions" (**second occurrence**), delete "(a and"; |
| | line 36, | before "in", delete "b)". |

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

| | | |
|---|---|---|
| Col. 10, | line 29, | after "portions", replace ", while that" by --. The chipping rate--. |
| | line 31, | replace "slightly" by --significantly--; |
| | line 35, | after "portions", replace ", while that" by --. The wear resistance--; |
| | line 42, | after "compositions", replace "(wt. %)" by --L and M of different weight percentages as--; |
| | line 44, | after "and" insert --then--; |
| | line 45, | replace "so that boating" by --. Thereby sample L has a composition according to the invention, while sample M is a comparative sample. Coating--; |
| | line 50, | after "thicknesses" insert --, a and b respectively,--; |
| | line 51, | delete "(a and b)"; |
| Col. 11, | line 13, | after "were" insert --approximately--; |
| | line 18, | after "nitrides," insert --or--; |
| | line 23, | after "25°", delete "in" ; |
| | line 24, | before "of", replace "a size" by --and a dimension--; after "as", replace "viewed" by --measured--; |
| | line 39, | before "Table" insert --Fig. 4A and--, |
| | line 40, | replace "shows thicknesses" by --show thickness a--, after "layers" insert --3--. |

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 11, line 41, after "and" (first occurrence) insert --thickness b of--, after "portions", delete "(a and b)", liner 42, after "therebetween." insert --As also shown in Fig. 4A, the chamfered insert edge portion has a lateral width C of 0.1 mm, and a chamfer angle $\alpha$ of 25°.--;

line 53, after "N", replace "was provided with" by --according to the invention has--;

line 54, after "O", replace "was provided with no" by --did not have--.

Col. 12, line 1, after "invention", replace "are now" by --will now be--;

line 5, after "having" insert --different weight percentage--, after "compositions", delete "(wt. %)";

line 13, after "inner" insert --coating--;

line 15, after "outer" insert --coating--; after "oxide", insert --to form a coating layer 2--, before "Table 8, insert --Thus, each inventive sample had a structure generally as shown in Fig. 2B and the conventional sample had a structure generally as shown in Fig. 3B, but with an enriched layer 4' instead of a $\beta$ free layer 3 shown in Figs. 2B and 3B.--;

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

| | | |
|---|---|---|
| Col. 12, | line 16, | after "layers", replace "4" by --4'--; |
| | line 17, | after "layers", replace "4" by --4'--; |
| | line 19, | after "contained", delete "an the interiors"; |
| | line 21, | after "surfaces" insert --relative to the content in the interior or internal core of the base material--; |
| | line 64, | after "having" insert --different weight percentage--, after "compositions", delete "(wt. %)"; |
| | line 66, | after "samples" insert --comprising a coating layer on a cemented carbide base material including a low hardness layer or region of the base material under the coating layer--; |
| Col. 13, | line 3, | after "of" insert --the--; |
| | line 51, | after " the" insert --inventive--; |
| | line 53, | after "is", replace "a little bit" by --somewhat--; |
| | line 56, | after "than" insert --comparative--; after "which", delete "has"; |
| | line 57, | before "low" replace "no" by --does not have a--; |
| | line 59, | after "having" insert --different weight percentage--, delete "(wt. %)"; |
| | line 60, | after "were" insert --used to make inventive sample L1 and conventional sample M1. Sample L1 was--; |
| | line 61, | after "and" insert --then--; |

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

| | | |
|---|---|---|
| Col. 13, | line 62, | after "layers 2", replace "to prepare coated cemented" by --while sample M1 was first sintered and then ground to be chamfered--; |
| | line 63, | before ".", "replace "carbide samples" by --having binder phase enriched layers on a surface portion of the base material, under the coating layer--; |
| | line 65, | before "Table", replace "Examples 6 and 7." by --Examples 5 and 6.-- |
| Col. 14, | line 2, | after "Co", delete "with respect"; |
| | line 3, | before "in", delete "to the interiors--; |
| | line 5, | after "surfaces" insert --relative to the base material interior--; |
| | line 7, | after "The", delete "portions correspond to the"; |
| | line 33, | after "layers", delete "and/or low hardness layers"; |
| | line 66, | after "the" insert --conventional--; |
| | line 67, | after "the" insert --inventive--; |
| Col. 15, | line 3, | after "nitrides," insert --or--, after "carbo-nitrides", replace "," by --of--, after "Hf" insert --and because sample M1 had no binder phase enriched layer at the edge portion--. |
| | line 16, | after "times", replace "that on" by --the thickness of--; |
| | line 26, | after "invention", replace "are now" by --will now be--; |

UNITED STATES PATENT AND TRADEMARK OFFICE

CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 15, line 35, after "to", replace "have" by --form--, after "curved", replace "surfaces" by --or rounded edges--;
line 36, after "bodies", replace "sensing", by --serving--
line 37, after "inner" insert --coating--;
line 39, after "outer" insert --coating--;
line 40, after "inner" insert --coating--;
line 43, after "outer" insert --coating--;
line 61, after "layer", replace "4 and" by --4' or--.
line 65, after "to", delete "the" (first occurrence), after "group", replace "5a" by --VB--;
line 66, after "in" insert --inner layers or--;
line 67, after "samples" insert --relative to the internal core of the samples--;

Col. 16, line 31, before "Time", replace "Chatting" by --Cutting--;
Table 15, column 2, line 3, replace "5a" by --VB--;
column 3, line 3, please replace "Zr of Hf" by --Zr or Hf--.
line 52, after "A3", replace "was provided with" by --contained--;
line 57, before "grain" (both instances), delete "in";

UNITED STATES PATENT AND TRADEMARK OFFICE
CERTIFICATE OF CORRECTION

PATENT NO. : 5,914,181

DATED : Jun. 22, 1999

INVENTOR(S) : Uchino et al.

It is certified that error appears in the above-identified patent and that said Letters Patent is hereby corrected as shown below:

Col. 17, Table 17, last column in Sample 15, third line from bottom: replace "0" by --10--
line 28, after "inner" insert --coating--;
line 29, after "outer" insert --coating--;
line 30, before "subjected", replace "to be" by --and then--; after "following", replace "ting" by --cutting--;
line 34, after "Cutting", replace "Steed" by --Speed--;
Col. 18, line 46, before "grain" (both instances), delete "in";
line 62, after "inner" insert --coating--;
line 63, after "outer" insert --coating--.
Col. 19, Table 19, Sample 30 should read:
--WC-15wt%TiCN-10wt%TaC-10wt%NbC-2wt%Co
WC-4wt%TiN-2wt%TaC-6wt%Co--.
Col. 20, line 59, after "under", delete "the";
line 60, after "and" (second occurrence) insert --measurement of--.
Col. 21, Table 22, Col. 3, under heading "W. (wt.%)":
line 3, delete "[6]";
line 9, delete "[6]";
Col. 4, line 8, replace "4" by --4--;
Col. 5, line 9, replace "0.08" by --0.08--.
Col. 23, line 66, cancel the entire line;
line 67, cancel the entire line;

UNITED STATES PATENT AND TRADEMARK OFFICE

CERTIFICATE OF CORRECTION

PATENT NO. : 5,914,181 Psge 16 of 16

DATED : Jun. 22, 1999

INVENTOR(S) : Uchino et al.

It is certified that error appears in the above-identified patent and that said Letters Patent is hereby corrected as shown below:

Col. 24, line 1, cancel the entire line;
line 2, cancel the entire line;
line 3, cancel the entire line;
line 4, cancel the entire line;
line 5, cancel the entire line;
line 26, after "100", replace "μMm" by --μm--.

Signed and Sealed this

Twenty-eighth Day of November, 2000

*Attest:*

*Attesting Officer*

Q. TODD DICKINSON

*Director of Patents and Trademarks*